US006492951B1

(12) United States Patent
Harris et al.

(10) Patent No.: US 6,492,951 B1
(45) Date of Patent: Dec. 10, 2002

(54) PLASMA ANTENNA

(75) Inventors: Jeffrey Hunter Harris, Queanbeyan (AU); Gerard George Borg, Cook (AU); Noel Maxwell Martin, Joslin (AU)

(73) Assignees: The Australian National University, Acton (AU); Defence Science and Technology, Salisbury (AU)

( * ) Notice: Subject to any disclaimer, the term of this patent is extended or adjusted under 35 U.S.C. 154(b) by 0 days.

(21) Appl. No.: 09/807,098

(22) PCT Filed: Oct. 6, 1999

(86) PCT No.: PCT/AU99/00857

§ 371 (c)(1),
(2), (4) Date: Jul. 10, 2001

(87) PCT Pub. No.: WO00/21156

PCT Pub. Date: Apr. 13, 2000

(30) Foreign Application Priority Data

Oct. 6, 1998 (AU) ..... 6352/98

(51) Int. Cl.[7] ..... H01Q 1/26
(52) U.S. Cl. ..... 343/701
(58) Field of Search ..... 343/701; 315/111.51, 315/248; 333/99 PL; 331/94.5

(56) References Cited

U.S. PATENT DOCUMENTS 3,602,837 A * 8/1971 Goldsborough ..... 333/99
4,213,818 A * 7/1980 Lemons et al. ..... 156/643
5,187,457 A * 2/1993 Chawla et al. ..... 333/170
5,327,049 A * 7/1994 Smolka et al. ..... 315/248
5,418,431 A 5/1995 Williamson et al. .... 315/111.51
5,594,456 A 1/1997 Norris et al. ..... 343/701
5,900,699 A 5/1999 Samukawa et al. ..... 315/111.51
5,907,221 A 5/1999 Sato et al. ..... 315/111.51
5,963,169 A 10/1999 Anderson et al. ..... 343/701

OTHER PUBLICATIONS

Burykin et al., "The Radiation of Electromagnetic Waves by a Variable Cross Section Cylindrical Plasma Waveguide," *Radio Engineering & Electronic Physics*, vol. 20, 11/75.

* cited by examiner

*Primary Examiner*—Don Wong
*Assistant Examiner*—Hoang Nguyen

(57) ABSTRACT

A system for information transmission having a plasma antenna, including an electrodeless plasma tube, and a power source effective to generate an electromagnetic field to cause ionization of material within the tube so as to form the antenna for one or both of either sending or receiving signals, wherein the electromagnetic field is applied to a portion only of the tube. The system preferably includes a terminal arranged about a base of the tube or establishing the electromagnetic field upon application of power from the power source, to induce surface wave ionization within the tube.

25 Claims, 1 Drawing Sheet

PLASMA ANTENNA

RELATED APPLICATIONS

This application claims priority under 35 U.S.C. §365(*a*) from International Application No. PCT/AU99/00857, filed Oct. 6, 1999, and published under PCT Article 21(2) on Apr. 13, 2000 in English, which is hereby incorporated by reference.

TECHNICAL FIELD

The present invention relates to a new type of plasma antenna for use in an information transmission system and, in particular, to a surface wave driven plasma antenna formed within a dielectric tube enabling furtive communications.

BACKGROUND OF THE INVENTION

Presently, antennas based on a plasma discharge are known. U.S. Pat. No. 5,594,456 discloses a device whereby a pulsed antenna is utilised for the transmission and reception of signals in Ground Penetrating Radar and high speed data communication applications. However, this device requires metallic electrodes with associated wires and a radio-frequency decoupling device to drive the plasma antenna which limit its applicability as a communications device and more specifically as a furtive communications device.

A surface wave driven plasma is also known, as set out in the publication Burykin Yu I., Levitskiy S. M. and Martyneko V. G. (1975) Radio Eng. Electron. Phys. 20, 86. However this publication does not concern itself with developing the plasma as a communications device. It is not obvious in the slightest that the combination of the above-mentioned prior art would produce the present invention.

Conventional conducting element antennas are also known and used widely. However, these antennae are not furtive due to their metallic components. Additionally, plasma antennas may be made flexible in the sense that the radiation pattern may be altered by changing the plasma density, or conversely maintaining the radiation pattern when the frequency is altered. These possibilities are not possible with simple metallic elements in conventional antennas.

This identifies a need for an improved type plasma antenna using a furtive means of operation and overcoming the problems inherent in the prior art.

SUMMARY OF THE INVENTION

In accordance with one aspect of the invention, there is provided a system for information transmission having a plasma antenna. The system may include an electrodeless plasma tube; and a power source effective to generate an electromagnetic field to cause ionization of material within the tube so as to form the antenna for one or both of either sending or receiving signals, wherein the electromagnetic field is applied to a portion of the tube.

The system may also include a terminal arranged about the tube at said portion for establishing the electromagnetic field upon application of power from the power source to induce surface wave ionization within the tube.

The use of surface wave ionisation provides a significant advantage over the antenna disclosed in U.S. Pat. No. 5,594,456 in that the plasma can be formed utilising only a single terminal and the metallic electrodes of the prior art may be dispensed with. This has particular advantage in stealth applications where metal componentry needs to be minimised to reduce a radar cross-section. Further, a single terminal may be used to both derive the plasma and generate a transmission signal which reduces component parts. Another specific advantage is that the antenna in tunable in the sense that the extent of surface wave ionisation can be controlled, allowing for dynamic control of the length and thereby operational frequency of the antenna. None of these advantages are contemplated or suggested in the prior art.

Preferably, the system comprises a furtive wireless communications device, said apparatus acting as either, or both, the transmitter and the receiver. By "furtive" is meant that the antenna is only in existence and detectable when in operation. As soon as ionising power is terminated, the antenna ceases to exist.

Preferably, the system employs a means to use multiple frequencies simultaneously for the functions of plasma formation and maintenance, and signal transmission and reception.

Preferably, the plasma density and/or plasma dielectric properties is/are controllable by external means including, but not limited to, radio-frequency power supplied to said plasma excitation means, the frequency of said radio-frequency power, phase changes of the radio-frequency power, an applied magnetic field, the gas pressure or a gases partial pressure.

In another aspect, there is provided a method of communication, including providing an electrodeless plasma tube an establishing a plasma in the tube by surface wave ionisation to form a plasma antenna for one or both of either receipt or transmission of signals.

Preferably, the method includes controlling the plasma density and/or plasma dielectric properties by external means including, but not limited to, the radio-frequency power supplied to said plasma excitation means, the frequency of said radio-frequency power, phase changes of the radio-frequency power, an applied magnetic field, the gas pressure or a gases partial pressure.

Preferably, the method includes providing an array of plasma tubes, individual tubes being arranged and excited as to permit control of the overall radiation pattern arising from the array of antennae, the mutual coupling between individual antennae, frequency stepping of individual antennae, power loading of individual antennae, and the tuning of the array of antennae.

BRIEF DESCRIPTION OF THE DRAWINGS

The present invention will become better understood from the following detailed description of a preferred but non-limiting embodiment thereof, described in connection with the accompanying drawings, wherein.

DETAILED DESCRIPTION OF THE PREFERRED EMBODIMENT

Figure 1:
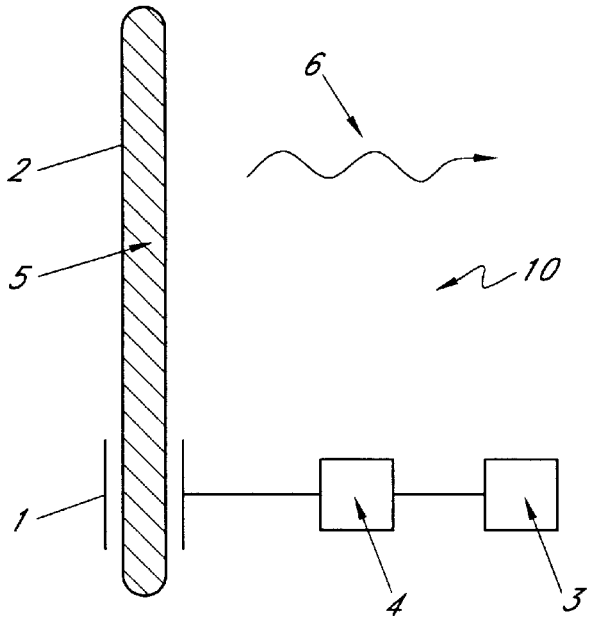
FIG. 1 illustrates a system of the invention.

A system 10 for information transmission or receipt is shown in FIG. 1. The system 10 has a terminal in the form of a cylindrical copper sleeve 1 wrapped around a base of an electrode-less dielectric tube 2.

A radio-frequency (RF) power generator 3 supplies RF power to the copper sleeve via impedance matching circuitry 4. The copper sleeve establishes an electromagnetic field in the tube which causes surface wave ionisation of material within the tube such that a plasma antenna 5 is created and maintained within the dielectric tube. The length of the copper sleeve may be adjusted to minimise spurious harmonic generation during coupling.

The antenna 5 may be utilised for either sending or receiving communications signals. To send a signal 6 the surface wave may be made to propagate in the plasma so as to induce a net radio-frequency current to flow along the antenna, this current generates electromagnetic waves that may be transmitted from the antenna in the form of the signal 6. For multiple frequency operation, multiple sleeve couplers can be employed.

Power from the generator 3 may also be controlled to limit the extent of the surface wave along the tube 2 in order to vary the length of the antenna and thereby its operating frequency, as required. Additionally, or alternatively, the physical characteristics of the plasma may be modified to alter operational parameters, such as by controlling the plasma density and/or plasma dielectric properties by external means including, but not limited to, the radio-frequency power supplied to said plasma excitation means, the frequency of said radio-frequency power, phase changes of the radio-frequency power, an applied magnetic field, the gas pressure or the partial pressures of a mix of gases. Changes in the radiation pattern can be produced by altering the plasma density, or conversely by maintaining a constant radiation pattern by varying the frequency.

Aside from the adaptability of the antenna with respect to signal output, the system has a particular advantage insofar as radar detectability. As there is only a single terminal (or radio-frequency feed point) at one end of the plasma tube, or in any event about only a portion of the tube 2, and no conducting connection to the other end of the tube, the antenna in its present embodiment has a low radar cross-section giving stealthy as well as furtive properties.

With regard to power requirements of the antenna 5, radio-frequency power may be coupled in a continuous wave fashion or pulsed at a selected frequency. Continuous wave coupling may be used for high frequency (HF), very high frequency (VHF), or ultra high frequency (UHF) transmission and reception. The plasma may be pulsed at intervals typically as short as a tenth of the plasma decay time allowing more efficient plasma production and lower power cost.

The gas from which the plasma is formed is typically, but not necessarily, a noble gas, the addition of other gases such as oxygen is also possible depending upon the plasma properties desired. Oxygen or a similar electron-scavenging gas can be added to damp signal ringing. Low radio-frequency power is required for operation of the invention, typically less than 200 Watts, the frequency range is typically 1–150 MHZ, with a gas pressure of a few milli-tor giving plasma densities of the order $10^{11}$–$10^{12}$ $cm^{-3}$. The numbers mentioned hereinbefore should not be taken as limiting the scope of the invention but merely indicating typical operating parameters.

It will be understood that, whilst a very specific embodiment has been described. numerous other variations and modification of the invention will become apparent to persons skilled in the art. All such variations and modifications should be considered to fall within the spirit and scope of the invention as broadly hereinbefore described.

Figure 2:
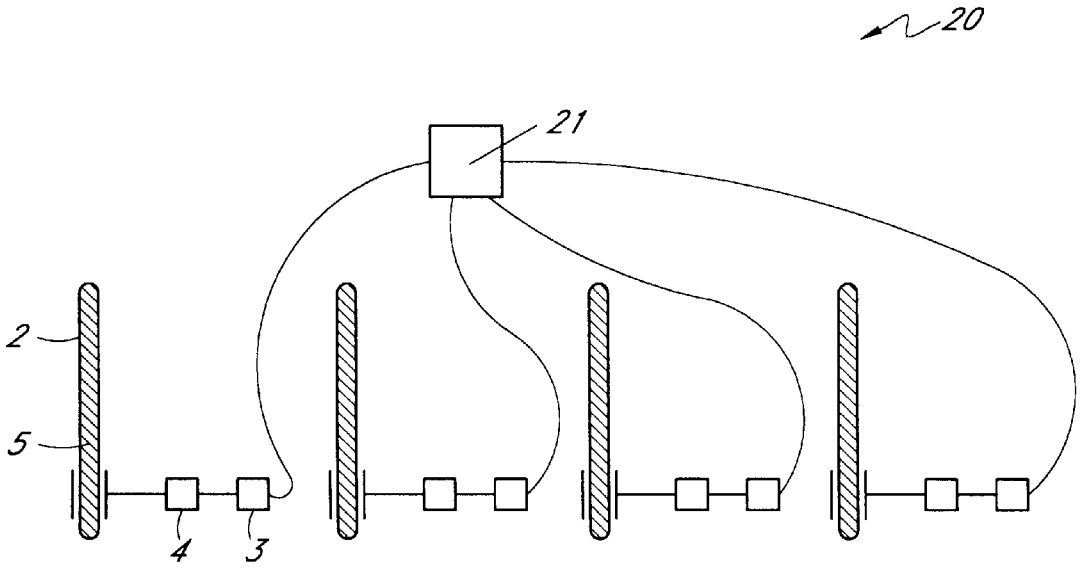
FIG. 2 illustrates an antenna array utilising the system of FIG. 1.

In FIG. 2 a plurality of tubes 2, formed in accordance with the above, are networked to form an antenna array 20. The individual tubes are operated from a central controller 21 and are selectively excited to permit control of an overall radiation pattern arising from the array, the mutual coupling between individual antennae produced, frequency stepping of individual antennae, power loading of individual antennae and the tuning of the array as a whole.

The manner of forming the plasma has been described as being by way of surface wave ionisation. Other means of ionisation used in connection with an electrode tube may achieve the same advantages of the invention. These means of excitation include but are not limited to travelling wave excitation, standing wave excitation, helicon wave excitation, microwave excitation, electrostatic excitation, or evanescent wave excitation, whereby the excitation means operates substantially in the radio-frequency range which includes, but is not limited to, high frequency, very high frequency, and ultra high frequency, said excitation means being coupled to the plasma as continuous wave or pulsed.

What is claimed is:

1. A system for information transmission having a plasma antenna, comprising:

an electrodeless plasma tube; and a power source effective to generate an electromagnetic field to cause ionization of material within the tube so as to form the antenna for one or both of either sending or receiving signals, wherein the electromagnetic field is applied to a portion of the tube.

2. The system as claimed in claim 1, further comprising a terminal arranged about the tube at the portion for establishing the electromagnetic field upon application of power from the power source to induce surface wave ionization within the tube.

3. The system as claimed in claim 2, wherein the power source is adapted to modulate the power applied to the tube such that the extent of the surface wave ionization along the length of the tube, and thereby the antenna length is variable to allow for tuning of the antenna to different operational frequencies.

4. The system as claimed in claim 3, wherein the surface wave ionization is established to provide a net current along the length of the antenna, the current being modulated to carry a signal which is transmitted by the antenna.

5. The system as claimed in claim 3, wherein the terminal comprises a band of conductive material positioned at one end of the tube.

6. The system as claimed in claim 3, further comprising a plurality of plasma tubes for forming an antenna array.

7. The system as claimed in claim 2, wherein the surface wave ionization is established to provide a net current along the length of the antenna, the current being modulated to carry a signal which is transmitted by the antenna.

8. The system as claimed in claim 7, wherein the terminal comprises a band of conductive material positioned at one end of the tube.

9. The system as claimed in claim 7, further comprising a plurality of plasma tubes for forming an antenna array.

10. The system as claimed in claim 2, wherein the terminal comprises a band of conductive material positioned at one end of the tube.

11. The system as claimed in claim 10, further comprising a plurality of plasma tubes for forming an antenna array.

12. The system as claimed in claim 2, further comprising a plurality of plasma tubes for forming an antenna array.

13. The system as claimed in claim 1, further comprising a plurality of plasma tubes for forming an antenna array.

14. A method of communication, comprising:

providing an electrodeless plasma tube; and establishing a plasma in the tube by surface wave ionization to form a plasma antenna for one or both of either receipt or transmission of signals.

15. The method as claimed in claim 14, further comprising supplying power to the tube to vary the extent of surface wave ionization along the length of the tube so as to effect a change in effective length of the antenna and thereby allow the antenna to be tuned to different frequencies.

16. The method as claimed in claim 15, further comprising providing and selectively energizing a plurality of plasma tubes to form an antenna array.

17. The method as claimed in claim 14, further comprising establishing a net current along the antenna for signal transmission.

18. The method as claimed in claim 17, further comprising using a single terminal to effect surface wave ionization and signal transmission.

19. The method as claimed in claim 18, further comprising providing and selectively energizing a plurality of plasma tubes to form an antenna array.

20. The method as claimed in claim 19, further comprising providing and selectively energizing a plurality of plasma tubes to form an antenna array.

21. The method as claimed in claim 14, further comprising providing and selectively energizing a plurality of plasma tubes to form an antenna array.

22. An information transmission system, comprising:

an electrodeless dielectric tube having a material therein; and a terminal having a portion of the tube disposed therein and receiving power from a power source to produce an electromagnetic field therein, whereby the electromagnetic field excites surface wave ionization in the material to produce a plasma antenna in the tube for transmitting and receiving signals.

23. The system defined in claim 22, further comprising a matching circuit interposed between the terminal and the power source for matching the terminal and the power source with respect to power.

24. The system defined in claim 22, wherein the power source is a RF generator.

25. The system defined in claim 22, wherein the terminal is a cylindrical copper sleeve that wraps around the portion of the tube.

* * * * *